US005845452A

United States Patent [19]

Pantano

[11] Patent Number: 5,845,452

[45] Date of Patent: Dec. 8, 1998

[54] ROOF ANCHOR FOR SAFETY EQUIPMENT

[75] Inventor: Marcel Peter Pantano, Mississauga, Canada

[73] Assignee: 1083015 Ontario Limited O/A Master Technologies, Mississauga, Canada

[21] Appl. No.: 921,120

[22] Filed: Aug. 29, 1997

[51] Int. Cl.[6] ..... E04B 1/38

[52] U.S. Cl. ..... 52/698; 52/37; 248/237; 182/45

[58] Field of Search ..... 52/37, 698, 27, 52/749.1, 750, 703, 712; 248/237, 499; 182/45, 3

[56] References Cited

U.S. PATENT DOCUMENTS

| | | | |
|---|---|---|---|
| 232,556 | 9/1880 | Silvius | 182/45 X |
| 403,636 | 5/1889 | Bitterly | 182/45 |
| 2,628,796 | 2/1953 | Krizman | 248/237 X |
| 5,143,170 | 9/1992 | Hunt et al. | 248/237 X |
| 5,282,597 | 2/1994 | Babcock | 182/45 X |
| 5,361,558 | 11/1994 | Thornton et al. | 52/698 |

*Primary Examiner*—Creighton Smith
*Attorney, Agent, or Firm*—Hodgson, Russ, Andrews, Woods & Goodyear LLP

[57] ABSTRACT

An anchor for securing a safety line to a roof having a pair of sloping portions defining an angle therebetween. The anchor is in the form of a two person permanent roof anchor for use by the residential construction industry as an anchor point from which construction or contractor personnel may attach an approved life line to which an approved personal fall arrest safety device may be attached. The anchor comprises an anchor bracket having a pair of leg portions disposed at an angle in relation to the angle between the sloping portions of a roof so that the leg portions lie along the roof portions, and fasteners for attaching the leg portions to the roof portions. The anchor further comprises at least one coupling member and a component for hingedly connecting the coupling member to the anchor bracket on one of the leg portions, the coupling member having a formation thereon for connection to one end of a safety line, the other end of which is connected to safety equipment in the form of an approved personal fall arrest safety device for use by a person working on a roof. A pair of coupling members can be provided, each hingedly connected in a unidirectional manner to a corresponding one of the anchor bracket leg portions, the coupling members in turn being adapted for connection via two approved safety lines to a pair of approved fall arrest safety devices.

7 Claims, 6 Drawing Sheets

ROOF ANCHOR FOR SAFETY EQUIPMENT

BACKGROUND OF THE INVENTION

This invention relates to the art of safety apparatus, and more particularly to a new and improved roof anchor for safety equipment.

Safety systems and devices have been proposed for maintaining the safety of workers positioned on a roof, in particular for preventing roofers, construction workers and others from accidentally falling off roofs during construction, maintenance and other activities. Pitched roofs which have significant pitched portions or severe pitch angles can pose hazardous risks to such workers. The potential danger associated with the pitched roof working environment has become widely recognized, and there has been increased regulatory attention on maintaining safety for workers on pitched roof structures.

SUMMARY OF THE INVENTION

It would, therefore, be highly desirable to provide a new and improved anchor which is securable to most roofs having a peak style construction, which is permanently and directly installed on the roof sheathing, which can support weights recommended by OSHA and ANSI standards, and to which at least one and preferably two lifelines can be attached to hold approved personal fall ar rest safety devices.

The present invention provides an anchor for securing a safety line to a roof having a pair of sloping portions defining an angle therebetween. The anchor preferably is in the form of a two person permanent roof anchor for use by the residential construction industry as an anchor point from which construction or contractor personnel may attach an approved life line to which an approved personal fall arrest safety device may be attached. The anchor comprises anchor bracket means having a pair of leg portions disposed at an angle in relation to the angle between the sloping portions of a roof so that the leg portions lie along the roof portions, and means for attaching the leg portions to the roof portions. The anchor further comprises at least one coupling member and means for hingedly connecting the coupling member to the anchor bracket means on one of the leg portions, the coupling member having means thereon for connection to one end of a safety line, the other end of which is connected to approved safety equipment in the form of an approved personal fall arrest safety device for use by a person working on a roof. Preferably a pair of coupling members are provided, each hingedly connected in a unidirectional manner to a corresponding one of the anchor bracket leg portions, the coupling members in turn being adapted for connection via two safety lines to a pair of fall arrest safety devices.

The foregoing and additional advantages and characterizing features of the present invention will become clearly apparent upon a reading of the ensuing detailed description together with the included drawing wherein:

BRIEF DESCRIPTION OF THE DRAWING FIGURES

DETAILED DESCRIPTION OF THE ILLUSTRATED EMBODIMENT

Figure 1:
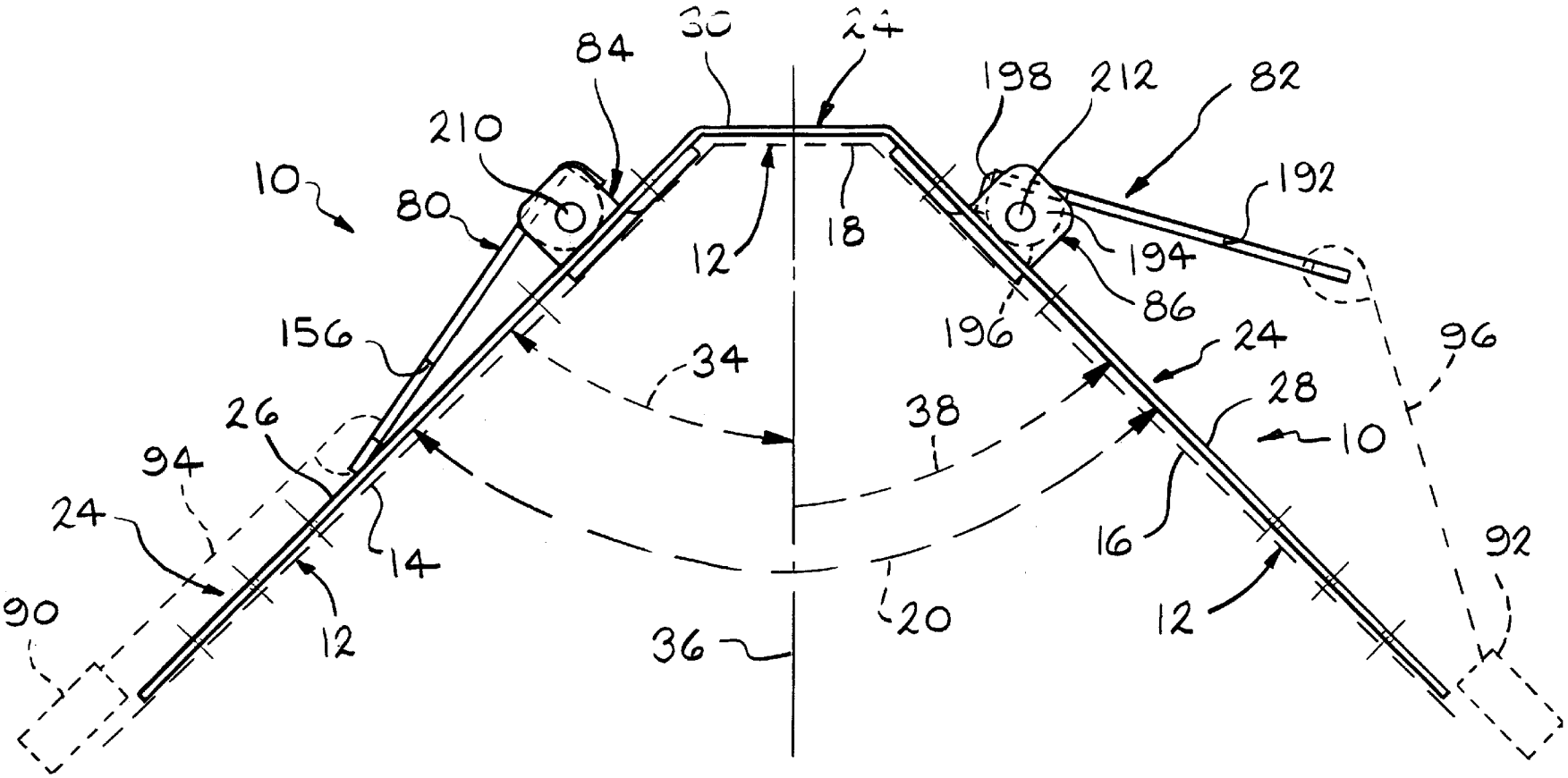
FIG. 1 is an elevational view of a roof anchor according to the present invention as it would appear in use.
Figure 2:
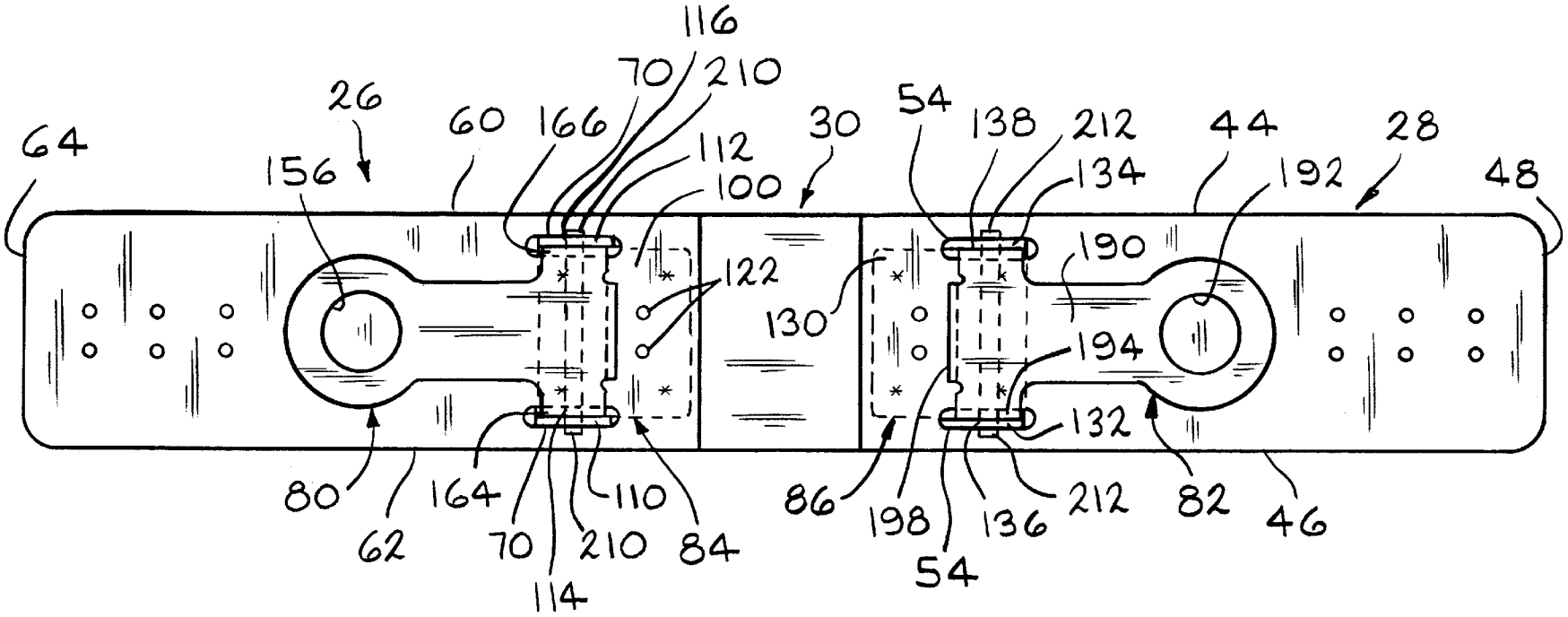
FIG. 2 is a plan view of the roof anchor of FIG. 1.

Referring to FIG. 1, there is shown an anchor 10 according to the present invention for securing at least one safety line to a roof represented diagrammatically at 12. Each safety line, in turn, is secured to a personal fall arrest safety device (not shown) such as an approved safety belt, harness or the like worn by persons working on a roof. Roof 12 includes a pair of sloping portions 14, 16 extending from an uppermost part 18 in a conventional manner. The roof sloping portions define an angle therebetween designated 20 in FIG. 1.

The anchor 10 according to the present invention comprises anchor bracket means generally designated 24 having a pair of leg portions 26 and 28 extending from a central portion 30. As shown in FIG. 1, leg portions 26 and 28 are disposed each at an angle to central portion 30 in relation to the angle 20 of sloping roof portions 14 and 16 so that leg portions 26 and 28 lie along roof portions 14 and 16, respectively. In the roof anchor 10 illustrated in FIG. 1, leg portion 26 defines an angle 34 with respect to a line 36 disposed perpendicular to central portion 30, and leg portion 28 defines an angle 38 with respect to line 36.

Figure 3:
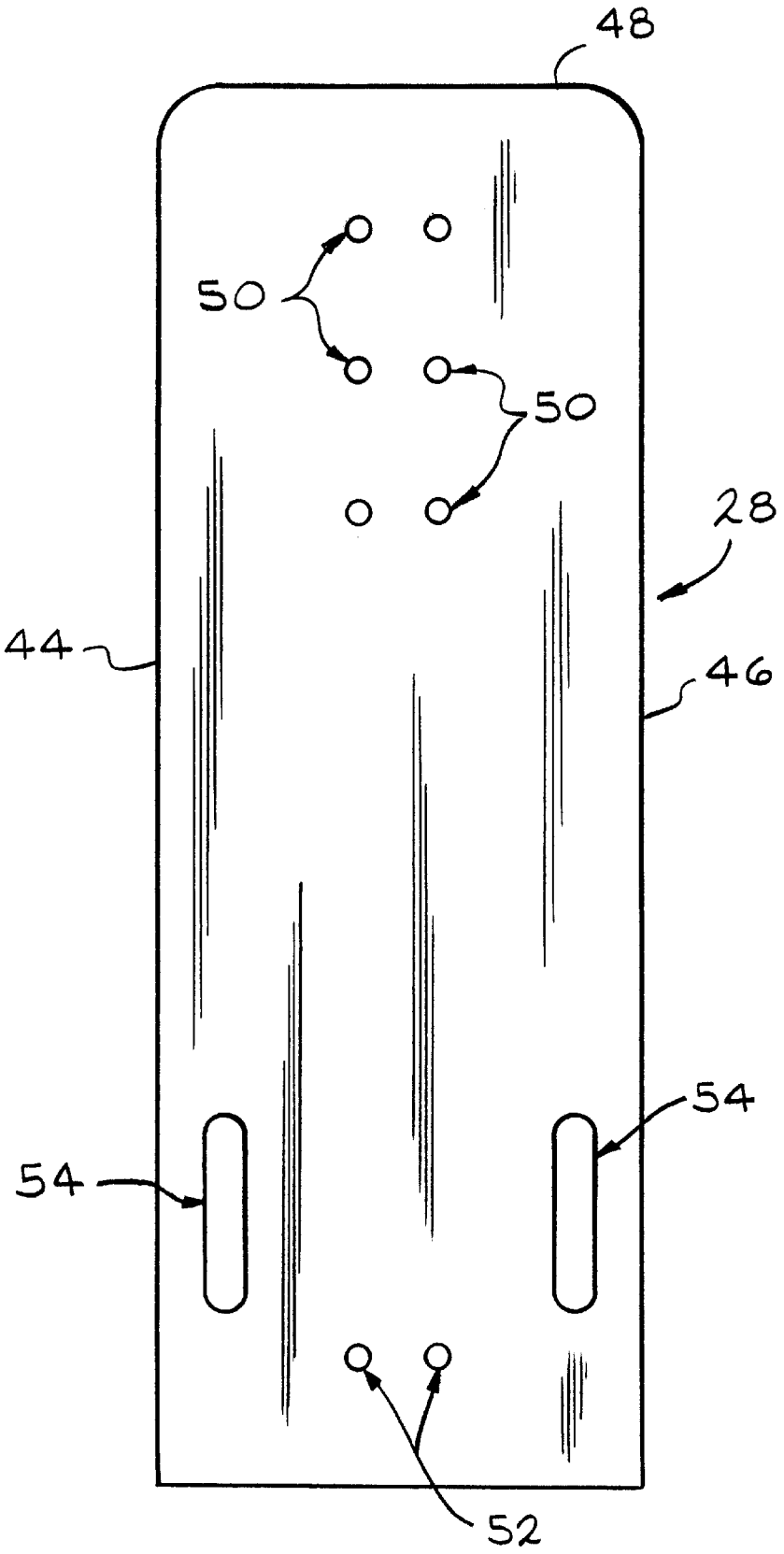
FIG. 3 is a fragmentary plan view showing one of the leg portions of the anchor bracket of the roof anchor of FIG. 1.

Anchor bracket means 24 is formed from a plate-like part die cut or punched from a sheet of metal such as steel and bent or otherwise formed to have the shape illustrated in FIG. 1 wherein leg portions 26 and 28 extend at angles from central portion 30. Each of the leg portions, for example leg portion 28 shown also in FIG. 3, is elongated rectangular in shape having a pair of side edges 44 and 46 which meet an end 48. Leg portion 28 is provided with apertures therein to receive fasteners for securing anchor bracket means 24 through the sheathing of a roof and into a supporting joist or rafter. In particular, a first set of apertures 50 is provided in leg portion 28 near end 48 and a second set of apertures 52 is provided near the junction with bracket central portion 30. Leg portion 28 also is provided with a pair of elongated, longitudinally extending slots 54 disposed parallel to edges 44, 46 located near the junction with central portion 30 and for a purpose which will be described.

Leg portion 26 is identical to portion 28 having side edges 60 and 62 meeting an end 64, first and second sets of apertures 66 and 68, respectively, and a pair of longitudinally extending slots 70. By way of example, in an illustrative roof anchor, bracket means 24 is punched or die cut from G90/C1008 galvanized steel having a thickness of about 2 mm. so that each leg portion 26 and 28 has a length of about 266.9 mm., central portion 30 has a length of about 63.5 mm. and the common width of leg portions 26, 28 and central portion 30 is about 91.2 mm.

The anchor 10 according to the present invention further comprises at least one coupling member for connection to one end of an approved safety line appropriately attached to an approved fall arrest safety device and means for hingedly connecting the coupling member to the anchor bracket means 24. Preferably, anchor 10 includes a pair of coupling members 80 and 82 connected by hinge brackets 84 and 86, respectively, to leg portions 26 and 28, respectively, of anchor 10. A pair of approved personal fall arrest safety devices, represented diagrammatically at 90 and 92 in FIG. 1, are secured to anchor 10, in particular by lines represented diagrammatically at 94 and 96 fastened to coupling members 80 and 82, respectively.

Figure 4:
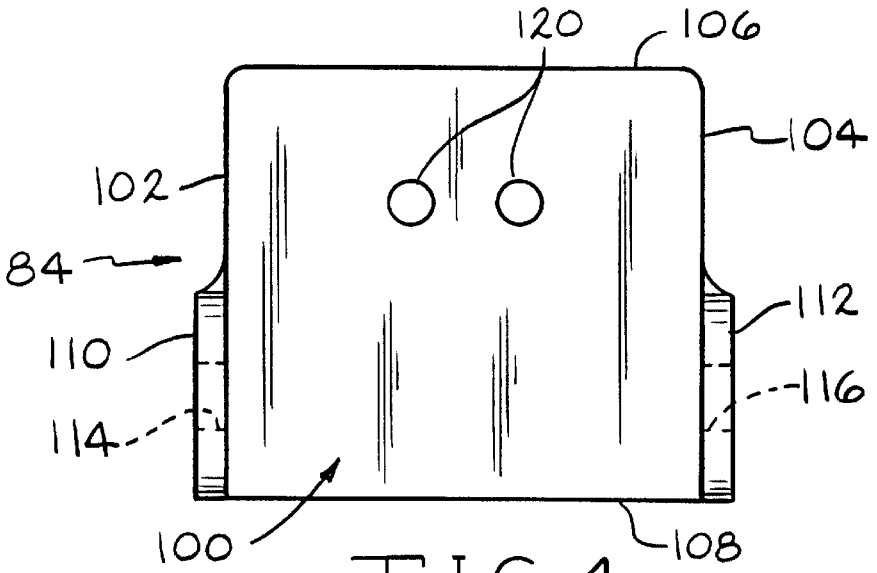
FIG. 4 is a plan view of one of the hinge brackets in the roof anchor of FIG. 1.
Figure 5:
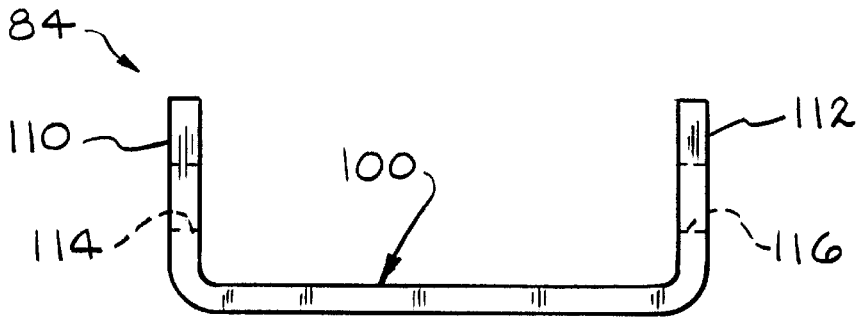
FIG. 5 is an end elevational view of the hinge bracket of FIG. 4.
Figure 6:
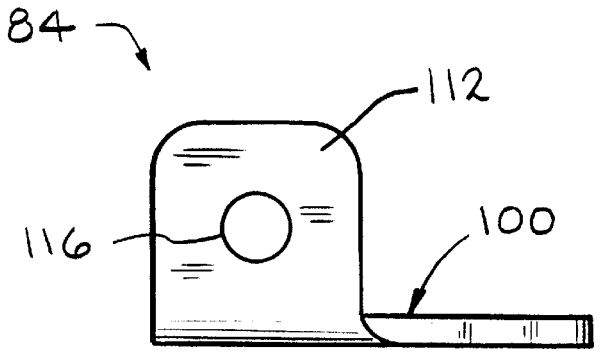
FIG. 6 is a side elevational view of the hinge bracket of FIG. 4.

FIGS. 4–6 show in detail one of the hinge brackets 84, it being understood that bracket 86 is identical to bracket 84. Bracket 84 includes a body portion 100 in the form a plate which is generally rectangular in shape having a pair of side edges 102 and 104 joined by a pair of end edges 106 and 108. Bracket 84 also includes a pair of hinge defining formations in the form of a pair of flanges 110 and 112 extending from sides 102 and 104 of plate 100 in the same direction and disposed substantially perpendicular to plate 100 and substantially parallel to each other. Flanges 110 and 112 are provided with aligned apertures 114 and 116, respectively, extending therethrough for a purpose which will be described. Flanges 110 and 112 are of a length, width and thickness so as to extend through slots 70 in leg portion 26 when bracket 84 is installed on leg portion 26 as shown in FIG. 1. Bracket 84 is installed on leg portion 26 with body portion 100 contacting the surface of leg portion 26 which faces toward the roof on which anchor 10 is installed and with the hinge defining formations 110 and 112 extending through slots 70 and outwardly from the opposite surface of leg portion 26. Aligned apertures 120 and 122 in plate 100 and leg portion 26, respectively, receive fasteners (not shown) for securing bracket 84 to leg portion 26. In addition, plate 100 is welded to leg portion 26.

Bracket 86 on leg portion 28 is identical to bracket 84 having plate-like body 130, hinge defining portions or flanges 132 and 134 extending from body 130 and aligned apertures 136 and 138 in flanges 132 and 134, respectively. By way of example, in an illustrative roof anchor, bracket 84 is punched or die cut from H.S.C.A. steel provided with a clear zinc finish and having a thickness of about 4.0 mm., the flanges 110, 112 being bent or formed to the dispositions shown in FIGS. 4–6 after the cutting or punching operation and after apertures 114, 116 and 120 are drilled therein. Plate 100 has a width of about 65.34 mm. and a length of about 60.50 mm. Each flange 110 and 112 has a length of about 27.0 mm. measured from the surface of plate 100 from which flanges 110, 112 extend, and each aperture 114, 116 has a diameter of about 9.35 mm. Bracket 86 is formed in a manner identical to that of bracket 84 and has the same illustrative dimensions.

Figure 7:
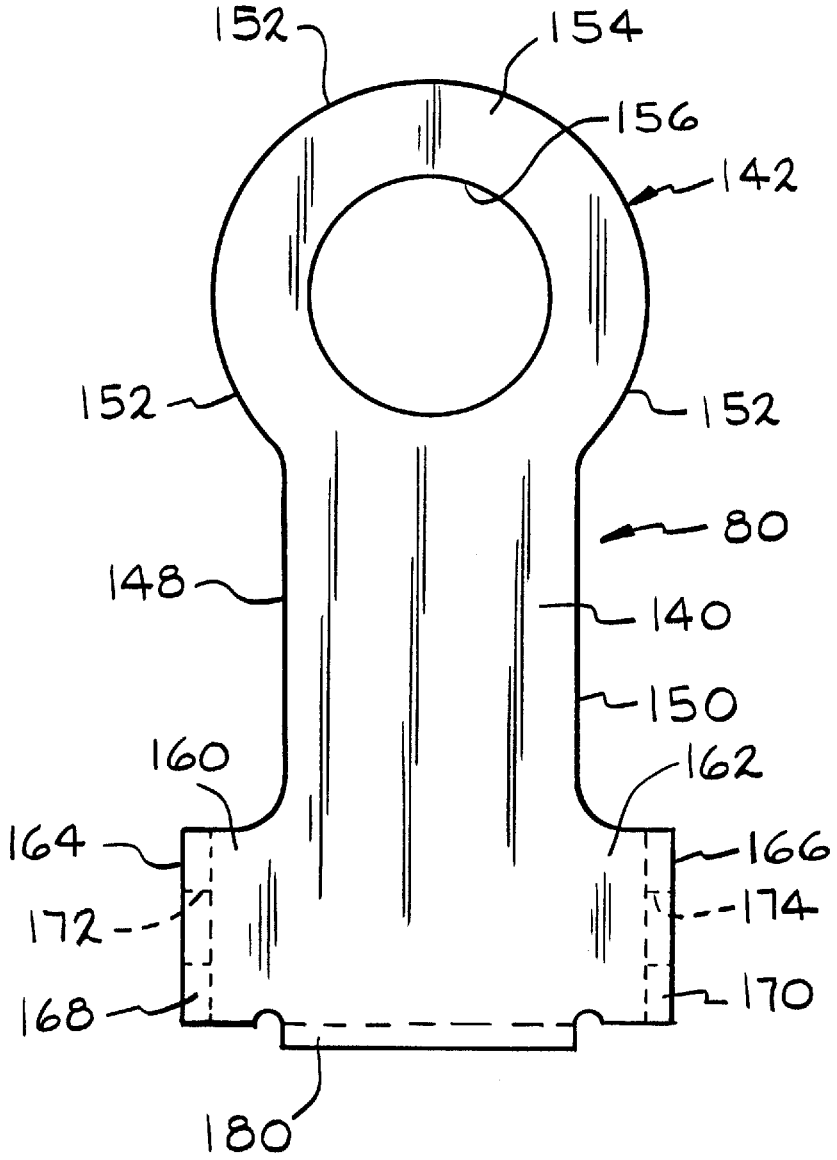
FIG. 7 is a plan view of one of the coupling members in the roof anchor of FIG. 1.
Figure 8:
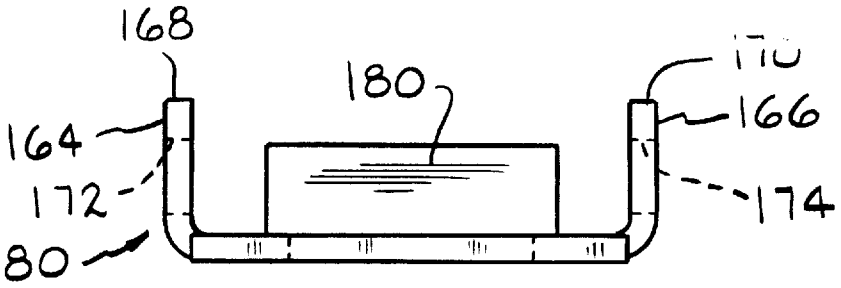
FIG. 8 is an end elevational view of the coupling member of FIG. 7.
Figure 9:
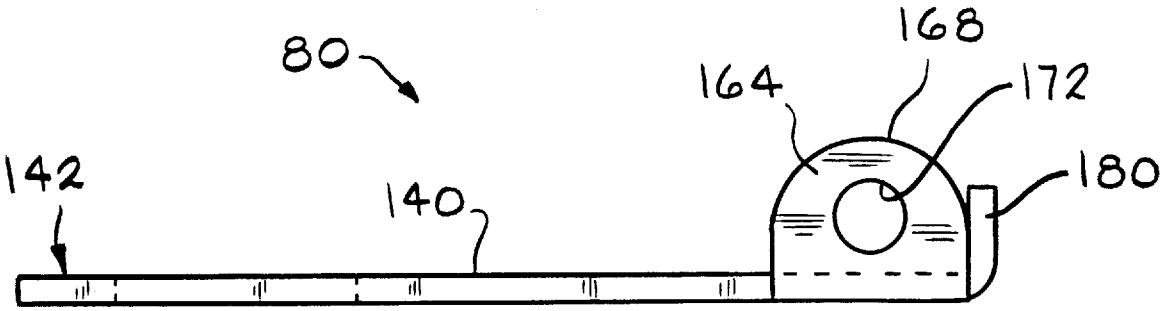
FIG. 9 is a side elevational view of the coupling member of FIG. 7.

FIGS. 7–9 show in detail one of the coupling members 80, it being understood that member 82 is identical to member 80. Coupling member 80 includes a plate-like body portion 140, means 142 on one end for connection to one end of an approved safety line, for example line 94 shown in FIG. 1, and means on the opposite end for providing a hinge connection to leg portion 26. Body portion 140 is generally rectangular in shape having a pair of side edges 148 and 150 which meet the peripheral edge 152 of a substantially circular end portion 154 provided with an opening 156. Opening 156 enables one end of a safety line, for example line 94 shown in FIG. 1, to be fastened to coupling member 80. Near the end of coupling member 80 opposite end portion 154 the side edges 148 and 150 meet laterally extending portions 160 and 162, respectively, of body 140. Lateral portions 160 and 162 terminate in flanges 164 and 166, respectively, disposed substantially perpendicular to the plane of body portion 140 and extending substantially parallel to each other in the same direction from portions 160 and 162. Flanges 164 and 166 have substantially semicircular peripheral edges 168 and 170, respectively, and are provided with openings 172 and 174, respectively, therethrough for a purpose to be described. The end of body portion 140 adjacent flanges 164 and 166 is provided with a laterally extending flange 180 for a purpose to be described. Flange 180 is disposed substantially perpendicular to the plane of body portion 140 and extends in the same direction as flanges 164 and 166 relative to the plane of body portion 140.

Coupling member 82 is identical to coupling member 80 having plate-like body portion 190, opening 192 near one and to facilitate fastening to one end of an approved safety line, for example line 96 shown in FIG. 1, flanges with semi-circular edges at the opposite end of body portion 190, one flange 194 and edge 196 being shown in FIG. 1, and a lateral flange 198. By way of example, in an illustrative roof anchor, coupling member 80 is punched or die cut from H.S.C.A. steel having a thickness of about 3.5 mm., the flanges 164, 166 and 180 being bent or formed to the dispositions shown in FIGS. 7–9 after the cutting or punching operation and after openings 156, 172 and 174 are provided therein. Coupling member 80 has an overall length of about 127.90 mm measured along the longitudinal axis of member 80 between edge 152 of end portion 154 and the outer surface of flange 180. The width of body portion 140 between side edges 148 and 150 is about 38.1 mm. Edge 152 is defined by a circle of radius of about 28.6 mm measured from the center of opening 156. Flanges 164 and 166 are spaced apart a distance about 57.15 mm measured between the inner surfaces thereof, and each flange 164, 166 has a length of about 25.5 mm and width of about 17.65 mm measured from the inner surface of body portion 140 to the outermost points on the flange peripheral edges 168 and 170. Each flange opening 172 and 174 has a diameter of about 9.5 mm. Flange 180 has a length of about 38.1 mm and a width of about 11.6 mm measured from the inner surface of body portion 140 to the edge of flange 180. Coupling member 82 is formed in a manner identical to that of member 80 and has the same illustrative dimensions.

In the assembly of anchor 10, bracket 84 is installed on leg portion 26 of anchor bracket 24 with body portion 100 contacting the surface of leg portion 26 which faces toward the roof on which anchor 10 is installed and with flanges 110 and 112 extending through slots 70 in leg portion 26. Bracket 84 is fixed to leg portion 26 by fasteners or welding or both as previously described. Similarly, bracket 86 is installed on leg portion 28 of anchor bracket 24 with body portion 130 contacting the surface of leg portion 28 which faces toward the roof on which anchor 10 is installed and with flanges 132 and 134 extending through slots 54 in leg portion 28. Bracket 86 likewise is fixed to leg portion 28 by fasteners or welding or both.

Coupling number 80 is located so that flanges 164 and 166 are located in the space between flanges 110 and 112 and that the peripheral edges 168 and 170 thereof face toward leg portion 26. The apertures 172 and 174 of flanges 164 and 166, respectively, are aligned with the apertures 114 and 116 of flanges 110 and 112, respectively, and a hinge pin 210 is inserted in the aligned apertures and fixed against substantial longitudinal movement in a suitable manner so that it remains in place. As a result, coupling member 80 is pivotally connected to leg portion 26 for limited pivotal movement about the axis of pin 210.

Similarly, coupling member 82 is located so that the flanges such as flange 194 are located in the space between flanges 132 and 134 of bracket 86 and so that the flange peripheral edges such as edge 196 face toward leg portion 28. The apertures of the flanges of coupling member 82 are aligned with the apertures 136 and 138 of bracket flanges 132 and 134, respectively, and a hinge pin 212 is inserted in the aligned apertures and fixed against substantial longitudinal movement in a suitable manner so that it remains in place. As a result, coupling member 82 is pivotally connected to leg portion 28 for limited pivotal movement about the axis of pin 212. By way of example, in an illustrative roof anchor, each hinge pin 210 and 212 is a rivet capped steel hinge pin having a shank diameter of about 9.15 mm and shank length of about 76.20 mm.

The pivotal movement of coupling members 80 and 82 facilitate connection of approved safety lines to members 80 and 82 when anchor 10 is secured to a roof. In particular, the end of each member, for example member 80 shown in FIG. 1, can be lifted or moved away a short distance from anchor bracket leg portion 26 to provide unrestricted access to opening 156 for connection or securement of the end of line 92 to member 80. The end or lateral flanges 180 and 198 of coupling member 80 and 82, respectively, serve to limit the degree of pivotal movement of each coupling member in a direction away from the respective leg portion of anchor bracket 24 for safety purposes. For example, FIG. 1 shows lateral flange 198 of coupling member 82 engaging the surface of leg portion 28 which prevents any further pivotal movement of coupling member 82 in a counter-clockwise direction as viewed in FIG. 1. This prevents the coupling member from being pivoted or swung back to a position where the end would be difficult or impossible to safely reach which could cause potential hazard or danger in a person reaching or stretching in an attempt to swing or move the coupling member back to the normal position.

The anchor 10 of the present invention, once assembled, can be secured to most residential roofs having a peak style construction. Anchor 10 is designed to be installed directly over the roof sheathing and secured to a rafter (anchor point) by means of sixteen 2.5 inch screws or ring-shank roofers' nails and is capable of supporting 5,000 pounds as recommended by OSHA and ANSI. Once permanently fastened to the roof, anchor 10 may be left in place for use by the home owner and/or contractors using approved safety equipment. The anchor 10 of the present invention, however, is not intended for use as a hoist anchor point.

Anchor 10 requires no caulking when properly installed. The safety stop uni-directional anchor rings or coupling members 80 and 82 allow for the safe connection of two approved individual personal fall arrest systems, one on each side of the roof peak. Anchor 10 is of heavy duty all steel construction, and the exposed coupling members are powder coated to inhibit corrosion. Anchor 10 is designed to meet the requirements of both OSHA (1910.66) and ANSI (Z359.1) standards when used with an approved personal fall arrest system.

It therefore is apparent that the present invention accomplishes its intended objects. While an embodiment of the present invention has been described in detail, that has been done for purposes of illustration, not limitation.

What is claimed is:

1. An anchor for securing a safety line to a roof having a pair of sloping portions defining an angle therebetween, said anchor comprising:

a) anchor bracket means having a pair of leg portions extending from a central portion, said leg portions being disposed at an angle to said central portion in relation to the angle between the sloping portions of a roof so that said leg portions lie along the sloping portions of a roof;

b) attachment means on said leg portions for securing said anchor bracket means to a roof;

c) a coupling member having means thereon for connection to one end of an approved safety line which provides an attachment point for an approved personal fall arrest safety device; and d) means for hingedly connecting said coupling member to said anchor bracket means on one of said leg portions thereof.

2. The anchor according to claim 1, wherein said means for hingedly connecting comprises a hinge bracket fixed to said one leg portion of said anchor bracket means and a hinge pin connected to said hinge bracket and to said coupling member.

3. The anchor according to claim 1, further including:

a) another coupling member having means thereon for connection to one end of another approved safety line which provides an attachment point for an approved personal fall arrest safety device; and b) means for hingedly connecting said another coupling member to said anchor bracket means on the other of said leg portions thereof.

4. The anchor according to claim 3, further including stop means operatively associated with each of said coupling members for limiting the degree of hinging movement of each of said coupling members relative to said anchor bracket means.

5. An anchor for securing an approved safety line to a roof having a pair of sloping portions defining an angle therebetween, said anchor comprising:

a) anchor bracket means having a pair of leg portions extending from a central portion, said leg portions being disposed at an angle to said central portion in relation to the angle between the sloping portions of a roof so that said leg portions lie along the sloping portions of a roof, each of said leg portions being in the form of a plate;

b) attachment means on said leg portions for securing said anchor bracket means to a roof;

c) at least one coupling member in the form of a plate having means thereon for connection to one end of an approved safety line which provides an attachment point for an approved personal fall arrest safety device;

d) means for hingedly connecting said coupling member to said anchor bracket means on one of said leg portion thereof, said means for hingedly connecting being in the form of a plate having first hinge defining formations thereon;

e) said one leg portion having openings therethrough for receiving said hinge defining formations;

f) second hinge defining formations on said coupling member co-operating with said first hinge defining formations on said hinge member; and g) hinge pin means operatively associated with said first and second hinge defining formations for hingedly connecting said coupling member to said anchor bracket means.

6. The anchor according to claim 5, further including:

a) another coupling member having means thereon for connection to one end of another approved safety line which provides an attachment point for an approved personal fall arrest safety device; and b) means for hingedly connecting said another coupling member to said anchor bracket means on the other of the leg portions thereof.

7. The anchor according to claim 6, further including stop means operatively associated with each of said coupling members for limiting the degree of hinging movement of each of said coupling members relative to said anchor bracket means.

* * * * *